US005088879A

United States Patent [19]

Ranly

[11] Patent Number: 5,088,879

[45] Date of Patent: Feb. 18, 1992

[54] FORWARD TILT LIMIT SYSTEM FOR LIFT TRUCKS

[75] Inventor: Matthew P. Ranly, Minster, Ohio

[73] Assignee: Crown Equipment Corporation, New Bremen, Ohio

[21] Appl. No.: 606,236

[22] Filed: Oct. 31, 1990

[51] Int. Cl.[5] ..... B66F 9/20

[52] U.S. Cl. ..... 414/636; 364/424.07

[58] Field of Search ..... 414/628-638; 364/424.01, 424.07

[56] References Cited

U.S. PATENT DOCUMENTS

| | | | |
|---|---|---|---|
| 2,937,777 | 5/1960 | Root | 414/636 |
| 3,929,244 | 12/1975 | Ekstrom | 414/636 |
| 4,003,487 | 1/1977 | Downing | 414/629 |
| 4,126,237 | 11/1978 | Downing et al. | 414/636 |
| 4,168,934 | 9/1979 | Downing et al. | 414/636 |
| 4,411,582 | 10/1983 | Nakada | 414/636 |
| 4,499,541 | 2/1985 | Yuki et al. | 414/636 X |
| 4,509,127 | 4/1985 | Yuki et al. | 414/636 X |
| 4,511,974 | 4/1985 | Nakane et al. | 414/634 X |

*Primary Examiner*—David A. Bucci
*Attorney, Agent, or Firm*—Biebel & French

[57] ABSTRACT

An electrical circuit for controlling the tilting of a mast assembly and the lifting of the fork of materials handling vehicles avoids the previously required extra control manipulations while continuing to maintain the safety standards for this type of vehicle. Electromechanical relays or their equivalent are employed to recall whether the tilt limit switch or the height limit switch was first actuated and allows the function associated therewith to continue even though other limit switch is subsequently actuated, thus reducing the number of control operations required during typical vehicle operations. The circuit senses whether both limit switches have been actuated when the vehicle is first powered up, and if so, then one of the limit switches must first be deactuated before either function is permitted to continue either forward or upward, thereby insuring that the vehicle will not be operated beyond predetermined safety limits.

5 Claims, 4 Drawing Sheets

FORWARD TILT LIMIT SYSTEM FOR LIFT TRUCKS

BACKGROUND OF THE INVENTION

This invention relates to an improved system for controlling the tilting of a mast assembly and the lifting of the fork of materials handling vehicles.

In several types of prior art materials handling vehicles, a mast assembly is provided which is capable of tilting in a forward direction to facilitate the loading or unloading of the materials carried by the vehicle. A pair of lift forks are carried by the mast assembly for lifting and carrying the materials.

In these vehicles, it is common to provide a single motor driven pump for providing hydraulic pressure to control the tilt of the mast assembly and also to control the lifting or lowering of the forks and perhaps accessory functions, such as moving the forks from side to side or for grasping loads, such as barrels.

The maximum forward tilt of the mast assembly is limited by the mechanical construction of the vehicle, but for safety reasons, there is usually provided a forward tilt limit beyond further tilting will not be permitted if the forks were also above their specified limit. This is shown in FIG. 2 as zone 15. The tilt limit is established by a limit switch which is actuated when the forward tilt reaches or exceeds a preset angle. Actuated merely means that the condition of the switch has changed after the event, either from open to closed or from closed to open.

The maximum height of the forks is also naturally limited by the physical structure of the mast assembly, but again for safety reasons, the forks will be limited in the height they can lift a load above the ground if the forward tilt of the mast assembly is beyond its predetermined limit. The height limit is established by a limit switch which is actuated by the fork assembly at a predetermined intermediate height.

As shown in FIG. 2, if the forks are between the ground and the height limit, as represented by line HL, then the forward tilt of the mast assembly will not be restricted; it may be tilted forward until it reaches its maximum tilt angle. Similarly, if the forward tilt of the mast assembly is between 0° and the tilt limit as represented by line TL, then the height to which the forks can be raised will not be limited by the system but can be raised to their maximum height. When either the forward tilt limit or the height limit has been exceeded, the vehicle will be operating in either the Tilt Limited Zone 20 or the Height Limited Zone 25.

No operation of the tilt or lift functions is permitted that would place the vehicle in the area or zone 15. A no restriction zone is established when neither limit has been exceeded, as illustrated by the area 10.

In prior art vehicles, if both of the limit switches have been activated, it would not be possible to continue either the forward tilt of the mast or the raising of the forks since operation of the single motor driven pump is usually terminated. It is always possible, however, to move the mast rearward or lower the forks, thus deactivating one or both of the switches.

As shown in FIG. 2, if the vehicle is in the height limited zone 25 and the forks are raised, when the height limit is reached, as represented by the point 26 on line HL, further raising is prohibited, but it should be permissible to continue to forward tilt the mast assembly, but in prior art vehicles, this is possible only after the forks have been lowered slightly, enough to release the fork limit switch, in order to forward tilt. Similarly, if the vehicle is in the tilt limited zone 20 and the mast is moved forward to its limit at point 22, then continued raising of the forks should be permissible, but prior art vehicles require that the forward tilt angle be reduced enough to release the tilt limit switch before such continued operation is permitted.

This type of operation of the prior art vehicles is a waste of time and requires additional manipulation of the controls, but it is also clear it was a result of concern that the vehicle not be permitted to operate in the restricted region 15.

SUMMARY OF THE INVENTION

The present invention is directed to an improved forward tilt limit system which avoids the extra control manipulations of the prior art while continuing to maintain the safety standards for this type of vehicle.

In the present invention, memory means are employed to recall which limit switch was first actuated and allows that function to continue even though other limit switch is subsequently actuated, thus reducing the number of control operations required during typical vehicle operations.

By way of example, assume the vehicle is in the condition represented by point 12 in FIG. 2, and the fork are lifted above the height limit HL to point 21 followed by a forward tilt to the tilt limit TL at point 22. In the prior art, further operations would have required that the tilt angle be reduced to release the tilt limit switch, but in the present invention, continued upward motion of the forks is permitted upwardly along that portion of the TL line identified as a–b until the forks reach their maximum height. This is possible because memory means were provided which sensed that the height limit switch closed first, and therefore continued upward movement of the forks was permitted even though the forward tilt limit was reached later. Under these circumstances, it is clear that the vehicle cannot be operated in the restricted zone 15.

Accordingly, it is an object of this invention to provide, in a materials handling vehicle that includes a mast assembly capable of tilting in a forward direction, a lift fork assemble capable of lifting a load, a single motor driven pump for providing hydraulic pressure for controlling the tilt of the mast assembly and the lifting of the forks, tilt limit switch means for limiting the forward tilting of the mast beyond a predetermined angle under certain conditions, and height limit switch means for limiting the raising of the forks above a predetermined height under certain conditions, an improvement comprising circuit means for sensing whether the tilt limit was reached before the height limit for permitting the continued uninterrupted operation of the tilting function when the lift limit is thereafter reached, and circuit means for sensing whether the height limit was reached before the tilt limit for permitting the continued uninterrupted operation of the lifting function when the forward tilt limit is thereafter reached.

Other objects and advantages of the invention will be apparent from the following description, the accompanying drawings and the appended claims.

DESCRIPTION OF THE PREFERRED EMBODIMENT

Figure 1:
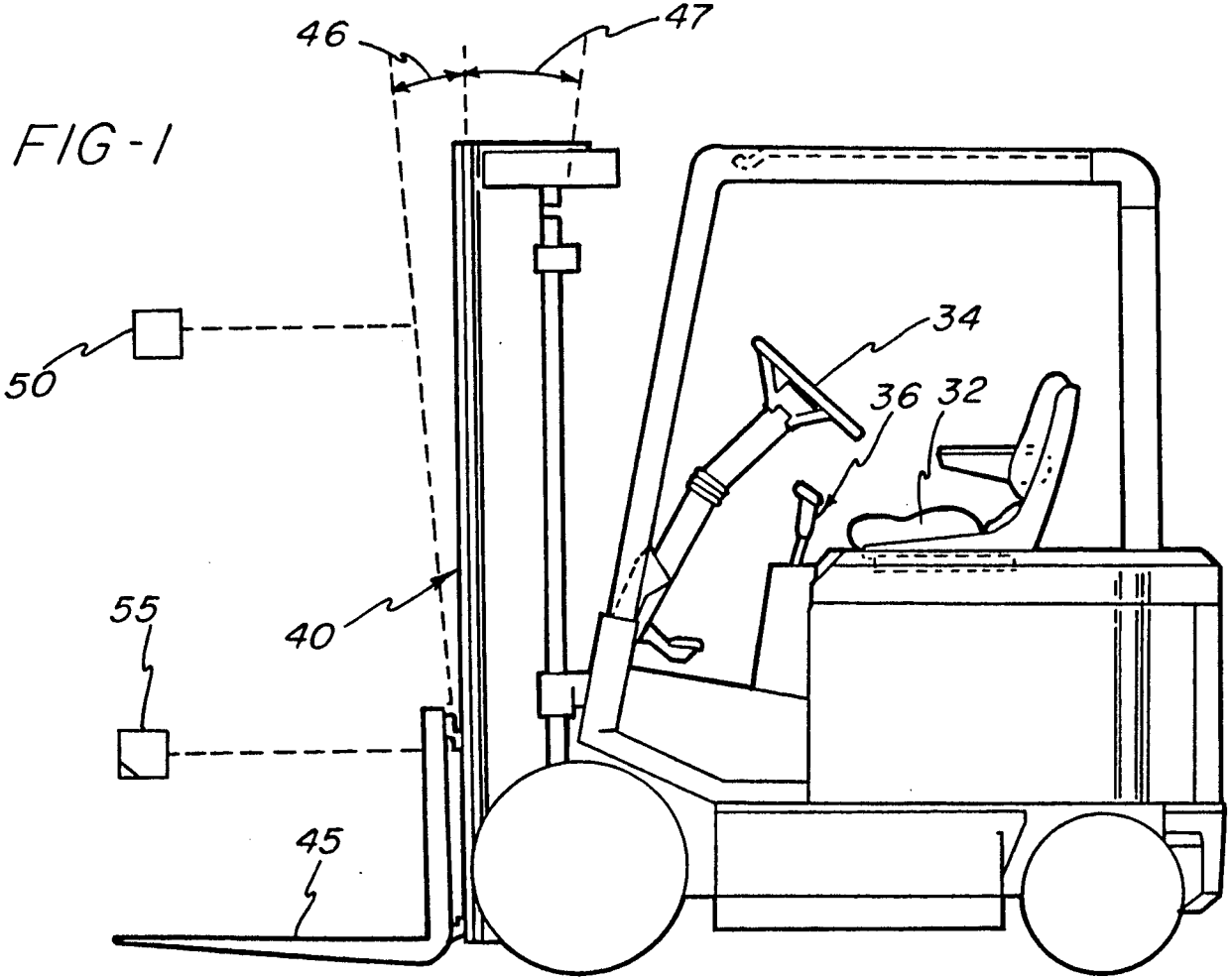
FIG. 1 is a perspective view of a materials handling vehicle or lift truck of the type that includes a mast assembly capable of tilting forward.

Reference is now to the drawings which illustrates a preferred embodiment of the invention and particularly to FIG. 1 which shows a materials handling vehicle 30. The vehicle includes an operators seat 32, a steering wheel 34 and control lever assembly 36.

A mast assembly 40 at the forward end of the vehicle includes a pair of lifting forks 45 that may be raised and lowered by conventional hydraulic means. The mast assembly itself may be tilted forward from the vertical through an angle 46 to facilitate the loading and unloading of the load on the forks, usually a pallet, and it may be tilted in the reverse direction through an angle 47 during transport to provide additional stability.

The maximum tilt angle of the mast assembly in either the forward or reverse direction is limited by mechanical constraints. For safety reasons, the forward tilt is further limited to a smaller angle whenever the forks are raised above a predetermined height limit. Similarly, the height of the forks is limited whenever the forward tilt angle of the mast assembly is beyond its forward limit.

A tilt limit switch 50 is associated with the mast assembly 40 to indicate whenever the forward tilt limit has been reached, and height limit switch 55 is associated with the forks to indicate whenever the height limit has been reached.

Figure 3:
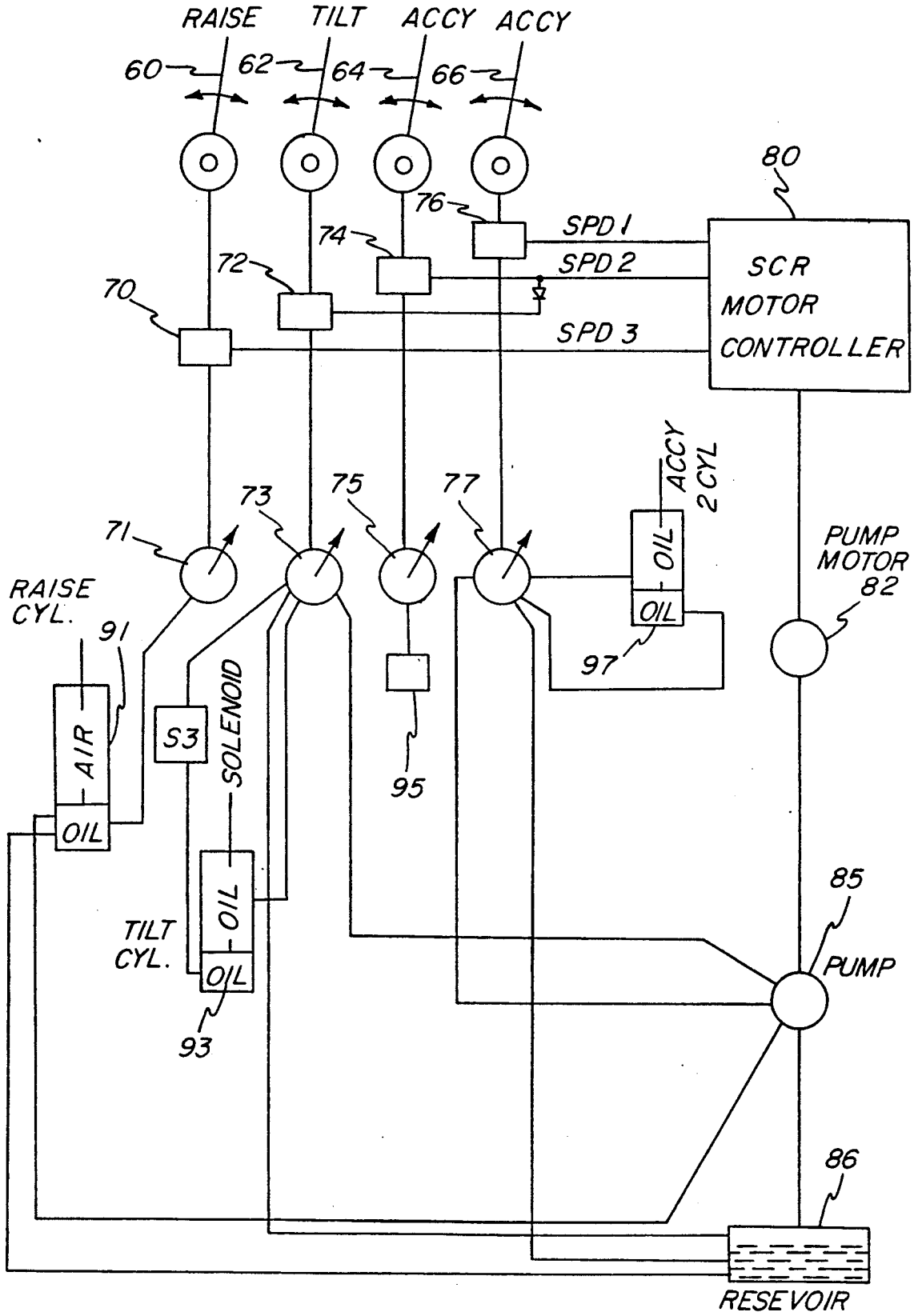
FIG. 3 is a simplified electrical and hydraulic schematic diagram showing the interconnection between control levers and the electrical switches and hydraulic valves associated with those levers.

The control lever assembly 36 include four levers placed near the operator's seat. Each of the control levers operate both electrical switches and control hydraulic valves, as shown in FIG. 3. Control lever 60 controls the raising of the forks 45, lever 62 controls the tilting of the mast assembly 40, and levers 64 and 66 control accessory functions ACCY1 and ACCY2.

Generally, the electrical switches cause power to be provided to an electrical motor that rotates an hydraulic pump providing pressure to the cylinders controlling the various functions of the vehicle. Each of the levers is spring loaded to a neutral position and can be moved either forward or backward from that position. Once moved out of the neutral position, the associated electrical switches are actuated while the amount of displacement from neutral controls the flow of hydraulic fluid passing through the valves.

As shown schematically in FIG. 3, the raise lever 60 operates raise switch 70 and hydraulic valve 71; the tilt lever 62 operates switch 72, comprising forward tilt switch FTS and reverse tilt switch RTS, and hydraulic valve 73; accessory lever 64 operates switch 74 and valve 75; and accessory lever 66 operates switch 76 and valve 77.

Each of the switches 70, 72, 74, 76 are connected to an SCR motor controller 80 which in turn operates a pump motor 82 at one of a variety of speeds selected according to the function required to be performed. In another embodiment of the invention, the pump motor speed is fixed, and in this embodiment, the SCR motor controller is not used, but rather the switches are connected directly to the pump motor itself. The hydraulic valves control the flow of fluid from a pump 85 and reservoir 86 to their respective hydraulic cylinders. Valve 71 controls the operation of raise cylinder 91 connected to the forks 45. Valve 73 controls the operation of tilt cylinder 93 that is connected to the mast assembly 40. Valves 75 and 77 control the operation their respective accessory cylinders 95 and 97.

Referring now to the electrical schematic diagram of FIG. 4, the operation of the improved circuit of the present invention will be described, and specifically with reference to the operation of the tilt memory means. Assuming first that the forward tilt of the mast assembly is less than the forward tilt limit, and the forks are below the height limit, or in other words, the vehicle is operating in the no restriction zone 10 of FIG. 2, and specifically at point 12, if the operator decides to move the mast forward, the tilt lever 62 will be moved forward, causing the forward tilt switch FTS to close. The pump motor 82 (FIG. 3) is operated under the control of the SCR motor controller 80 whenever any of the lines SPD-1, SPD-2 or SPD-3 is connected to the ground or negative line NEG.

In the present case, with switch FTS closed, line SPD-2 is grounded through diode D1 and a path through either the normally closed contacts of the tilt limit switch 50 or the height limit switch 55. Thus, the mast assembly will tilt forward, and as it does, it will eventually pass the tilt limit TL shown in FIG. 2. At this time, the tilt limit switch 50 will open. The vehicle is now in the Height Limited Zone 25. The operator now stops the forward tilt motion, as for example, at the point identified at 27.

Figure 2:
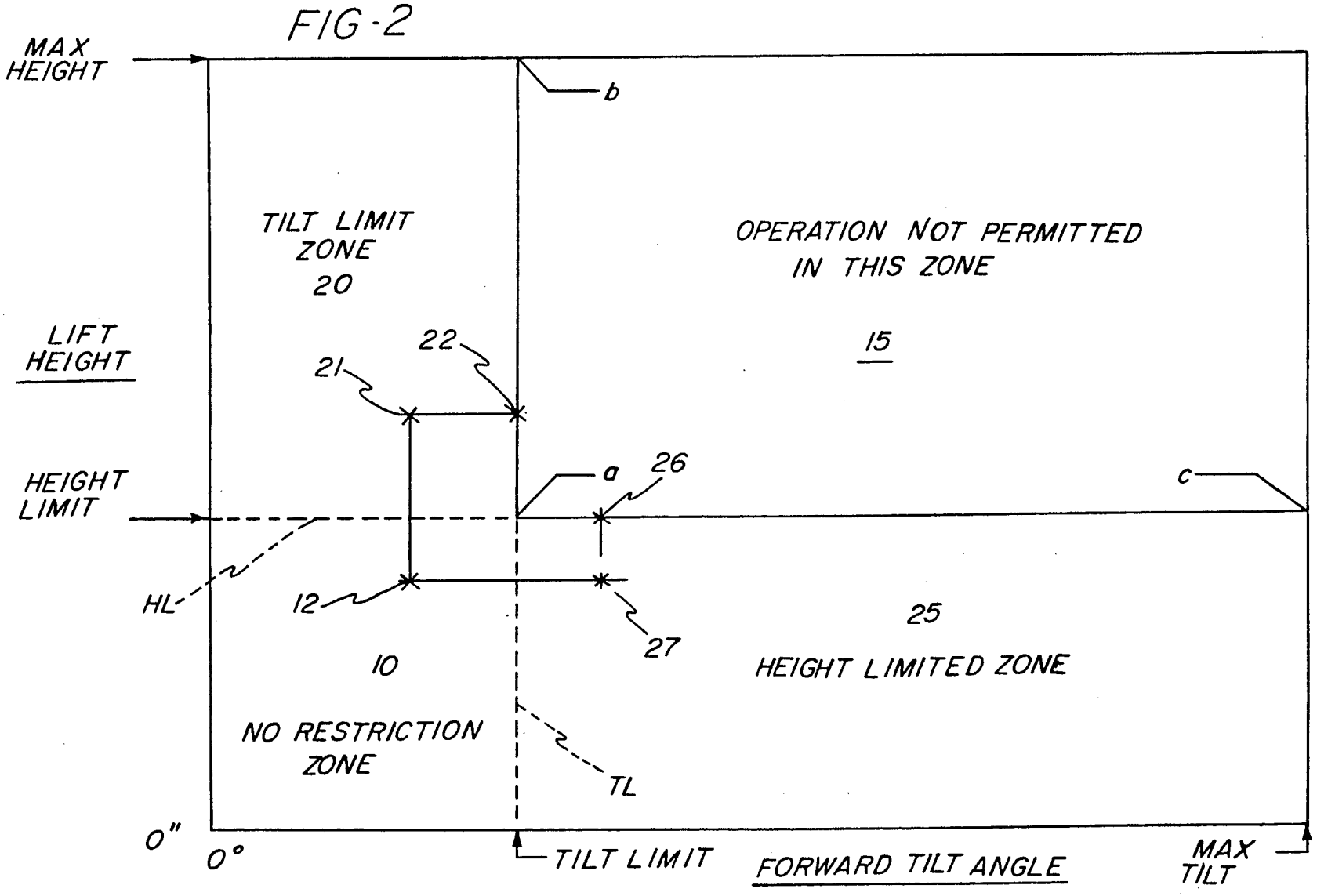
FIG. 2 is a chart showing the relationship between forward tilt angle, the height of the forks, and the restrictions placed on the vehicle.

As the tilt limit TL was reached when the mast moved forward from point 10 to 27 in FIG. 2, relay K1 was energized. This was accomplished through a path established by the normally closed contacts K2*a* of relay K2 and the now closed contact K3*b* of relay K3, which was energized initially through either 50 or 55 and held latched by contact K3*a*. Relay K2 will not be energized since the height limit is not reached in this example.

To raise the forks from this position, the raise lever 60 may be moved to the rear, actuating the raise switch 70. This switch is a two-circuit, double-break switch and therefore switch component RS1 will close and RS2 will open by this action. A circuit path for line SPD-3 to NEG is available through diode D2 and height limit switch 55 until the forks reach the height limit HL at which time the switch 55 opens, the path for line SPD-3 is opened and power to the pump motor 80 is removed. In FIG. 2, this point is illustrated at 26.

Forward tilting of the mast at this point is still possible since that would not bring the vehicle's operation into the prohibited zone 15. In FIG. 4, moving the forward tilt lever forward once again causes switch FTS to close, and line SPD-2 now finds a path to NEG through the now closed contacts K1*b* and the closed contacts RS2 of the raise switch.

Thus, forward tilt movement of the mast assembly can continue even after the height limit is reached, provided the tilt limit was reached first. Reverse tilt operation is always possible by operation of the switch RTS through the normally closed raise switch contact RS2.

Thus, the relay K1, and its associated contacts, provide memory means for indicating that the tilt limit TL was reach before the height limit HL. Similarly, operation of relay K2 provides a memory that the height limit is reached before the tilt limit since it is energized upon the actuation of the height limit switch 55, provided relay K1 has not been earlier energized.

Figure 4:
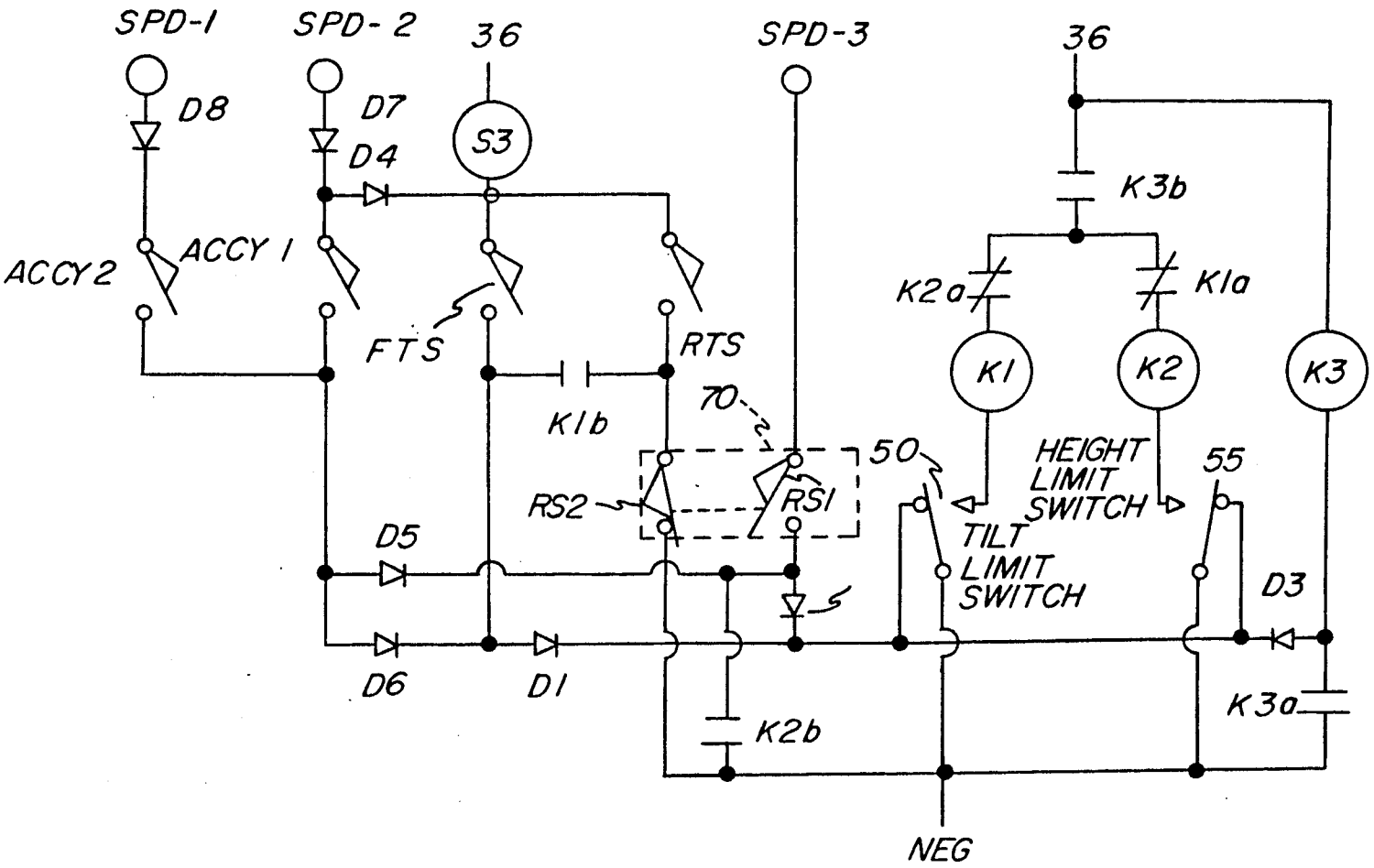
FIG. 4 is an electrical schematic diagram of the improved circuit of the present invention.

When battery power is first made available to the circuit of FIG. 4, relay K3 will energize through the path provided by diode D3 and either switch 50 or 55. A latch of this relay is provided by its contacts K3*a*, and its other contact K3*b* provides a path for the memory relays K1 and K2.

If both switches 50 and 55 are activated at power up, as would be the case if the vehicle was left at point 22 or 26 in FIG. 2, then relay K3 will not energize. The system will not know which relay was first activated before power was removed. Under these circumstances, it is possible to lower the forks since no electrical activity for that operation is required since only forward movement of the lever 60 is necessary to allow hydraulic fluid to pass through the valve 71 and the forks will lower under their own weight. The reverse tilt function is also available through diode D4 and contacts RS2. It is not, however, possible to raise the forks or forward tilt the mast, and therefore operation of the vehicle in zone 15 will not be permitted. If one of the switches 50 or 55 is thereafter deactivated, then the operation will continue as previously described.

In the vehicle of FIG. 1, the accessory functions are made available at all times unless the vehicle is operating on the line a–c of FIG. 2 and the raise lever is actuated. Since the accessary functions use the same hydraulic pump as the raise and mast tilt functions, it is necessary to prevent the pump from operating in response to the accessory lever switches when both the tilt and height limits since further movement of the raise lever might place the vehicle in zone 15 merely by action of the hydraulic valve 71. If the vehicle is operating on line a–c of FIG. 2, then the tilt limit was reached first and relay K1 is energized and relay K2 cannot be energized. Also, the height limit switch 55 will be open, so there is no path for the accessory functions lines SPD-1 and SPD-2 to find a ground except through diode D6, relay contacts K1*b* and the raise switch contacts RS2. Thus if the raise lever is moved from the neutral position in an attempt to raise the forks, then power to the motor will be removed.

If the vehicle is operating on line a–b of FIG. 2, on the other hand, then relay K2 will have energized first, and relay K1 is disabled. A ground path for the accessory functions is available through diode D5 and relay contacts K2*b*. Movement of the forward tilt lever will not cause the mast to move forward because, in order for the forward tilt function to operate, solenoid S3, which is in the forward tilt hydraulic line, must be energized, and since there is no ground path for this circuit, forward tilting under these circumstance is not permitted and operation in zone 15 is prevented.

Thus there is provided circuit means for preventing the inadvertent operation of the lift function into the prohibited zone while the accessory function is being operated if the height limit was first reached and then the tilt limit reached, and further circuit means for preventing the operation of the tilt function into the prohibited zone if the tilt limit was first reached and then the height limit reached.

While the form of apparatus herein described constitutes a preferred embodiment of this invention, it is to be understood that the invention is not limited to this precise form of apparatus and that changes may be made therein without departing from the scope of the invention, which is defined in the appended claims.

What is claimed is:

1. In a materials handling vehicle that includes a mast assembly capable of tilting in a forward direction, a lift fork assemble capable of lifting a load, a single motor driven pump for providing hydraulic pressure for controlling the tilt of the mast assembly and the lifting of the forks, tilt limit switch means for limiting the forward tilting of the mast beyond a predetermined angle under certain conditions, and height limit switch means for limiting the raising of the forks above a predetermined height under certain conditions, the improvement comprising circuit means for sensing whether the tilt limit was reached before the height limit for permitting the continued uninterrupted operation of the tilting function when the lift limit is thereafter reached, and circuit means for sensing whether the height limit was reached before the tilt limit for permitting the continued uninterrupted operation of the lifting function when the forward tilt limit is thereafter reached.

2. In a materials handling vehicle that includes a mast assembly capable of tilting in a forward direction, a lift fork assemble capable of lifting a load, at least one accessory function, a single motor driven pump for providing hydraulic pressure for controlling the tilt of the mast assembly, the lifting of the forks and the operation of the accessory assembly, tilt limit switch means for limiting the forward tilting of the mast beyond a predetermined angle under certain conditions, and height limit switch means for limiting the raising of the forks above a predetermined height under certain conditions, the improvement comprising circuit means for sensing whether the tilt limit was reached before the height limit for permitting the continued uninterrupted operation of the tilting function when the lift limit is thereafter reached, circuit means for sensing whether the height limit was reached before the tilt limit for permitting the continued uninterrupted operation of the lifting function when the forward tilt limit is thereafter reached, and circuit means for preventing operation of the tilting function while the accessory function is in operation if the height limit was first reached and the tilt function subsequently reached.

3. The materials handling vehicle of claim 2 further including circuit means for preventing the upward operation of the lifting function while an accessory function is being operated if the tilt limit was first reached and the height limit was subsequently reached.

4. The materials handling vehicle of claim 2 further including means for sensing, at initial power on of the vehicle, whether both said tilt limit and said height limit was reached, and means for preventing operation of both the tilting function and the lifting function until at least one of the tilt limit or height limit switches has been deactivated.

5. The materials handling vehicle of claim 2 wherein said tilt limit circuit means and said height limit circuit means includes electromechanical relays.

* * * * *